US006519912B1

(12) United States Patent
Eckmann et al.

(10) Patent No.: US 6,519,912 B1
(45) Date of Patent: Feb. 18, 2003

(54) COMPOSITE WOOD PRODUCTS

(75) Inventors: William Thomas Eckmann, Lufkin, TX (US); William B. Fulmer, III, Diboll, TX (US); David Franklin Kellam, Diboll, TX (US)

(73) Assignee: Temple-Inland Forest Products Corporation, Diboll, TX (US)

( * ) Notice: Subject to any disclaimer, the term of this patent is extended or adjusted under 35 U.S.C. 154(b) by 0 days.

(21) Appl. No.: 09/546,734

(22) Filed: Apr. 11, 2000

(51) Int. Cl.[7] ..... E04C 3/12; E04C 3/36
(52) U.S. Cl. ..... 52/730.7; 52/589.1
(58) Field of Search ..... 52/730.7, 729.4, 52/DIG. 8, 589.1; 446/124, 125

(56) References Cited

U.S. PATENT DOCUMENTS

| | | | | |
|---|---|---|---|---|
| 1,778,333 | A | 10/1930 | Neumann | |
| 2,421,305 | A * | 5/1947 | Wachsmann | 52/730.7 |
| 3,701,214 | A | 10/1972 | Sakamoto | |
| 4,055,019 | A | 10/1977 | Harvey | |
| 4,624,295 | A | 11/1986 | Howland | |
| 4,741,144 | A | 5/1988 | Graffin | |
| 4,897,140 | A | 1/1990 | Opsvik | |
| 5,050,653 | A | 9/1991 | Brown | |
| 5,109,898 | A | 5/1992 | Schacht | |
| 5,139,845 | A | 8/1992 | Beckerman et al. | |
| 5,207,046 | A | 5/1993 | Vekkeli | |
| 5,400,918 | A | 3/1995 | Prodaniuk | |
| 5,437,934 | A | 8/1995 | Witt et al. | |
| 5,560,177 | A | 10/1996 | Brightwell | |
| 5,870,876 | A | 2/1999 | Deiter | |
| 5,881,786 | A | 3/1999 | Wilderman et al. | |
| 5,899,251 | A | 5/1999 | Turner | |
| 5,900,304 | A | 5/1999 | Owens | |
| 5,944,928 | A | 8/1999 | Seidner | |
| 5,968,625 | A | 10/1999 | Hudson | |
| 6,025,053 | A | 2/2000 | Grenier | |
| 6,199,339 | B1 | 3/2001 | Mudry et al. | 52/574 |

FOREIGN PATENT DOCUMENTS

| | | |
|---|---|---|
| EP | 0134296 | 3/1985 |
| FR | 2649637 | 1/1991 |

* cited by examiner

*Primary Examiner*—Michael Safavi
(74) *Attorney, Agent, or Firm*—Conley Rose, P.C.

(57) ABSTRACT

A converted wood article for use in combination with other converted wood articles to form composite wood products for use in general construction such as in the construction of posts, flooring, walls, and support beams. Converted wood articles preferably include engaging surfaces and in composite wood products formed therefrom include joints between engaging surfaces which are displaced from the outer corners of the composite wood product. Adjacent engaging surfaces forming a joint preferably include correspondingly shaped inter-engaging portions. Further, converted wood articles have the notional cross-sectional shape of four-, five-, or six-sided polygons. The polygons preferably include at least one side having a notional plane therethrough which forms an acute angle with another side. Converted wood articles and composite wood products may be made by a method which includes converted wood articles having a grade or modulus of elasticity rating, and disposing the converted wood articles in the composite wood product according to their specified grade or modulus of elasticity.

64 Claims, 4 Drawing Sheets

Fig. 22
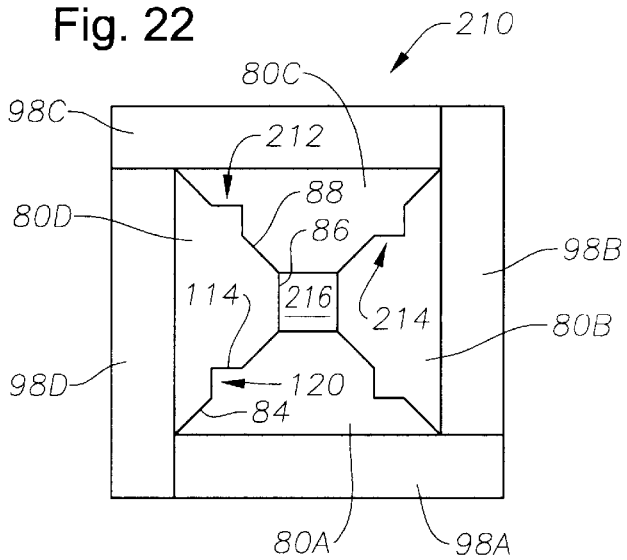
Fig. 23
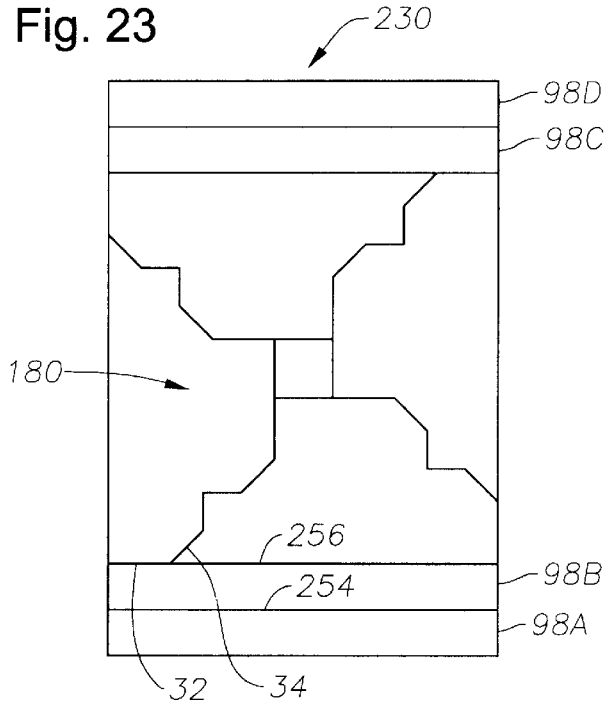
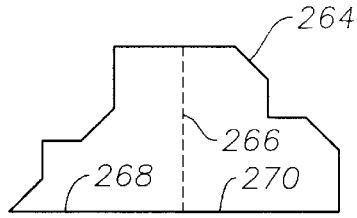
Fig. 25
Fig. 24
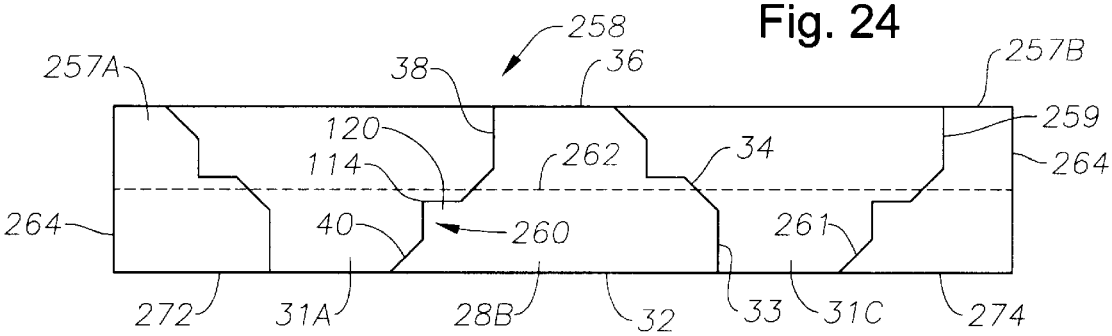

COMPOSITE WOOD PRODUCTS

BACKGROUND OF THE INVENTION

1. Field of the Invention

The present invention relates generally to converted wood articles and composite wood products made therefrom for use in general construction primarily but not limited to posts, flooring, walls, and support beams.

2. Description of the Related Art

The depletion of old growth forest has placed increasing demand within the forest industry for alternative wood products which make better use of old growth and stagnant growth timber and which also provide for greater use of second, third and later generation trees, as well as plantation tree thinnings and pulpwood. As the supply of large old-growth timber continues to be depleted, larger and larger amounts of smaller-sized timber, such as second, third, and subsequent growth timber and plantation timber will be converted into usable wood products. Since in the past it had been common practice with the large old-growth logs to have the freedom and flexibility to manufacture large-dimension wood products of various types, it is now necessary to conceive new products and methods of manufacture to convert the smaller-diameter timber into wood products that have the necessary dimensional and structural characteristics.

Several alternative wood products have emerged in an effort to address some of the needs in the industry. In this respect U.S. Pat. No. 4,394,409 discloses a composite wood product formed from four elongated triangular-shaped wood pieces. The four pieces are joined to form a composite wood product having a cross-sectional outline of a parallelogram and a hollow interior. An alternative embodiment is disclosed where each wood piece has a pair of machined keys to improve yield.

U.S. Pat. No. 5,299,400 discloses a composite wood product formed from four log parts, each log part having a three sided cross-section forming either right angled sectors and a third curved side or a right triangle. The log parts are assembled into a composite wood product so that their right angles form the corners of a rectangle with a hollow interior which is filled with concrete or other structural enhancing material. Similar examples of this alternative wood structure are disclosed in U.S. Pat. No. Re 35,327 and French Patent 962589. Other attempts to offer improved composite wood products are disclosed in French Patent 2512729 and German Patent 964637.

The present invention overcomes the deficiencies of the prior art.

SUMMARY OF THE INVENTION

The composite wood product of the present invention preferably includes a plurality of converted wood articles having a preferred cross-sectional profile. The cross-sectional profile is formed by at least an outer surface and at least two engaging surfaces. The engaging surfaces preferably include corresponding inter-engaging portions such that upon mating the engaging surfaces of adjacent converted wood articles, a joint is formed between the converted articles. The converted wood articles are then glued together to form the preferred composite wood product. The converted wood articles preferably include an extension surface extending between the outer surface and one of the engaging surfaces, whereby the joints between converted wood articles making up the composite wood product are displaced from the corners of the composite wood products. The composite wood product may include two pairs of opposing converted wood articles with each opposing pair of converted wood articles having a different modulus of elasticity. Further, the preferred composite wood product as described above may include standard wood pieces glued on opposite sides of the composite wood product to form a new composite wood product. The standard wood pieces on each side of the composite wood product may include wood pieces having a preferred modulus of elasticity.

The converted wood articles have cross-sectional shapes of four, five or six-sided polygons formed by notional lines through each of the surfaces forming the cross-sectional profile. Further, the sides of the polygons are arrayed such that a notional line through a joint between converted wood articles making up the composite wood product forms an acute angle with an outer surface of the composite wood product.

Still further, the present invention features a method of making converted wood articles including using converted wood articles having a specified grade or modulus of elasticity. Yet further, a method of making composite wood products may include disposing the converted wood articles in the composite wood product according to the specified grade or modulus of elasticity.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings. Other objects and advantages of the invention will appear from the following description.

BRIEF DESCRIPTION OF THE DRAWINGS

For a detailed description of the preferred embodiment of the present invention, reference will now be made to the accompanying drawings, wherein:

FIG. 22 is an end view of yet another wood product formed by a plurality of wood articles shown in FIG. 5 and a plurality of standard wood articles shown in FIG. 6;

FIG. 23 is an end view of still yet another wood product formed by the wood product shown in FIG. 17 and a plurality of standard wood articles shown in FIG. 6;

FIG. 24 is an end view of another wood product formed by a plurality of the wood articles shown in FIG. 7 and attached side-by-side with end wood articles; and FIG. 25 is an end view of the wood article from which the end wood articles of FIG. 24 are made.

DETAILED DESCRIPTION OF THE PREFERRED EMBODIMENT

Figure 1:
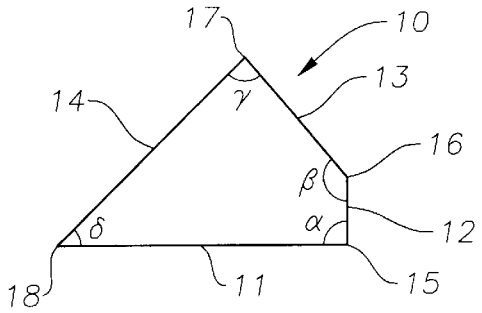
FIG. 1 is an end view of a wood article forming a first preferred profile of the present invention.

In the description which follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The composite wood product of the present invention includes various embodiments hereinafter described. Each wood product is made of two or more pieces of wood or wood articles affixed together to form wood members such as posts, flooring, walls, and support beams. Such wood members are shown and described with respect to FIGS. 15–24. The wood articles have engaging surfaces, some with inter-engaging portions, which mate and are typically glued to adjacent wood articles to form the wood members. The wood articles are cut or planed with a particular profile, such as the profiles shown and described with respect to FIGS. 1–6 and may include inter-engaging portions shown in FIGS. 7–14. The articles may be cut from different diameter logs to produce variable size wood articles.

Referring initially to FIG. 1, converted wood article 10 includes a wood piece having a length and a plurality of surfaces, ie., outer surface 11, extension surface 12, edge surface 13, and second edge surface 14. A cross-section through the wood article 10 forms the profile shown in FIG. 1. Notional planes through surfaces 11, 12, 13, and 14 intersect to form a cross-sectional shape of a four-side polygon with a first corner 15 formed by outer surface 11 and extension surface 12, a second corner 16 formed by extension surface 12 and edge surface 13, a third corner 17 formed by edge surface 13 and second edge surface 14, aid a fourth corner 18 formed by outer surface 11 and second edge surface 14. The progressive sequence of corners 15, 16, 17, and 18 define first angle $\alpha$, second angle $\beta$, third angle $\gamma$, and fourth angle $\delta$, respectively. First angle $\alpha$ and third angle $\gamma$ are preferably substantially right angles, second angle $\beta$ is preferably an obtuse angle, and fourth angle $\delta$ is preferably an acute angle.

Figure 2:
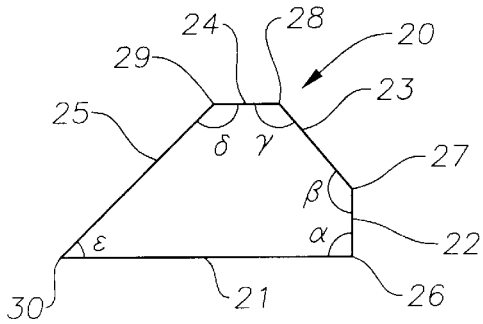
FIG. 2 is an end view of a wood article forming a second preferred profile of the present invention.

Referring now to FIG. 2, there is shown a second preferred embodiment of converted wood article 20 having another profile formed by outer surface 21, extension surface 22, edge surface 23, symmetry surface 24, and second edge surface 25. A cross-section through the wood article 20 forms the profile shown in FIG. 2. Notional planes through surfaces 21, 22, 23, 24, and 25 intersect to form a cross-sectional shape of a five-sided polygon with a first corner 26 formed by outer surface 21 and extension surface 22, a second corner 27 formed by extension surface 22 and edge surface 23, a third corner 28 formed by edge surface 23 and symmetry surface 24, a fourth corner 29 formed by symmetry surface 24 and second edge surface 25, and a fifth corner 30 formed by outer surface 21 and second edge surface 25. The progressive sequence of corners 26, 27, 28, 29, and 30 define first angle $\alpha$, second angle $\beta$, third angle $\gamma$, fourth angle $\delta$, and fifth angle $\epsilon$, respectively. First angle $\alpha$ is preferably a substantially right angle. Second angle $\beta$, third angle $\gamma$, and fourth angle $\delta$ are each preferably obtuse angles. Fifth angle $\epsilon$ is preferably an acute angle. Angles $\beta$ and $\epsilon$ preferably sum to approximately 180°.

Figure 3:
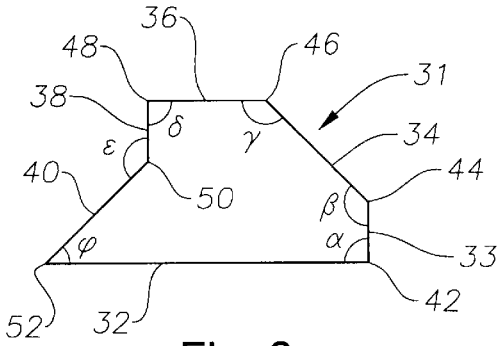
FIG. 3 is an end view of a wood article forming a third preferred profile of the present invention.

Referring now to FIG. 3, there is shown a third preferred embodiment of converted wood article 31 having another profile formed by outer surface 32, extension surface 33, edge surface 34, symmetry surface 36, second extension surface 38, and second edge surface 40. A cross-section through the wood article 31 forms the profile shown in FIG. 3. Notional planes through surfaces 32, 33, 34, 36, 38, and 40 intersect to form a cross-sectional shape of a six-side polygon with a first corner 42 formed by outer surface 32 and extension surface 33, a second corner 44 formed by extension surface 33 and edge surface 34, a third corner 46 formed by edge surface 34 and symmetry surface 36, a fourth corner 48 formed by symmetry surface 36 and second extension surface 38, a fifth corner 50 formed by second extension surface 38 and second edge surface 40, and a sixth corner 52 formed by outer surface 32 and second edge surface 40. The progressive sequence of corners 42, 44, 46, 48, 50, and 52 define first angle $\alpha$, second angle $\beta$, third angle $\gamma$, fourth angle $\delta$, fifth angle $\epsilon$, and sixth angle $\phi$, respectively. First angle $\alpha$ and fourth angle $\delta$ are preferably substantially right angles, second angle $\beta$, third angle $\gamma$, and fifth angle $\epsilon$ are preferably obtuse angles, and sixth angle $\phi$ is preferably an acute angle. Angles $\beta$, $\phi$ preferably sum to 180°. Alternatively, or in combination, angles $\beta$, $\epsilon$ are preferably the same.

Figure 4:
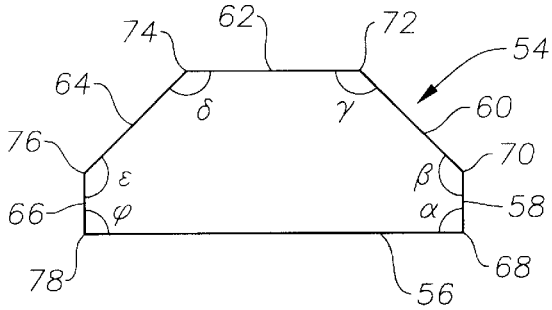
FIG. 4 is an end view of a wood article forming a fourth preferred profile of the present invention.

Referring now to FIG. 4, there is a fourth preferred embodiment of converted wood article 54 having a profile formed by outer surface 56, extension surface 58, edge surface 60, symmetry surface 62, second edge surface 64, and second extension surface 66. A cross-section through the wood article 54 forms the profile shown in FIG. 4. Notional planes through surfaces 56, 58, 60, 62, 64, and 66 intersect to form a cross-sectional shape of a six-sided polygon with a first corner 68 formed by outer surface 56 and extension surface 58, a second corner 70 formed by extension surface 58 and edge surface 60, a third corner 72 formed by edge surface 60 and symmetry surface 62, a fourth corner 74 formed by symmetry surface 62 and second edge surface 64, a fifth corner 76 formed by second edge surface 64 and second extension surface 66, and a sixth corner 78 formed by outer surface 56 and second extension surface 66. The progressive sequence of corners 68, 70, 72, 74, 76, and 78 define first angles $\alpha$, second angle $\beta$, third angle $\gamma$, fourth angle $\delta$, fifth angle $\epsilon$, and sixth angle $\phi$, respectively. First angle $\alpha$ and sixth angle $\phi$ are preferably substantially right angles and second angle $\beta$, third angle $\gamma$, fourth angle $\delta$, and fifth angle $\epsilon$ are each preferably obtuse angles. Angles $\beta$, $\epsilon$ are preferably the same and angles $\gamma$, $\delta$ are preferably the same.

Figure 5:
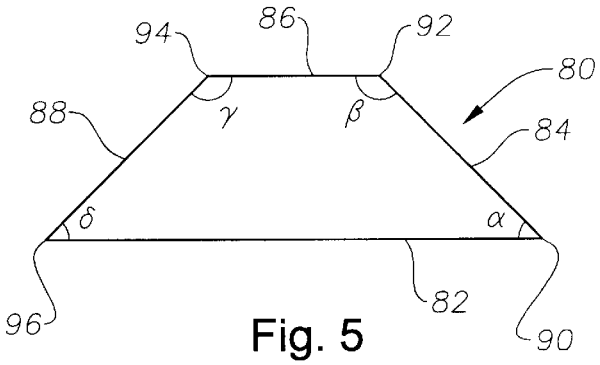
FIG. 5 is an end view of a wood article forming a fifth preferred profile of the present invention.

Referring now to FIG. 5, there is shown a fifth preferred embodiment of converted wood article 80 having another profile formed by outer surface 82, edge surface 84, symmetry surface 86, and second edge surface 88. A cross-section through the wood article 54 forms the profile shown in FIG. 5. Notional planes through surfaces 82, 84, 86, and 88 intersect to form a cross-sectional shape of a four-sided polygon with a first corner 90 formed by outer surface 82 and edge surface 84, a second corner 92 formed by edge surface 84 and symmetry surface 86, a third corner 94 formed by symmetry surface 86 and second edge surface 88, and a fourth corner 96 formed by outer surface 82 and second edge surface 88. The progressive sequence of corners 90, 92, 94, and 96 define first angle $\alpha$, second angle $\beta$, third angle $\gamma$, and fourth angle $\epsilon$, respectively. First angle $\alpha$ and fourth angle $\epsilon$ are preferably acute angles and second angle $\beta$ and third angle $\gamma$ are each preferably obtuse angles.

Figure 6:
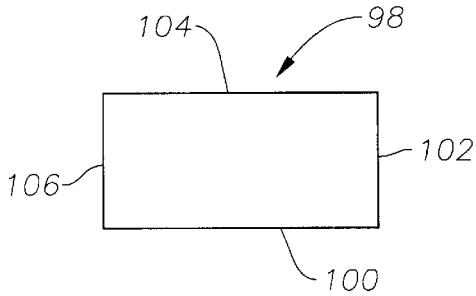
FIG. 6 is an end view of a standard wood article having a rectangular cross-section.

Referring now to FIG. 6, there is shown a standard wood article 98 having four parallel edge surfaces 100, 102, 104, and 106. Each pair of edge surfaces 100, 104 and 102, 100 are parallel. Notional planes through surfaces 100, 102, 104, and 106 intersecting to form a rectangular cross-section. The standard wood article 98 may by used in combination with other composite wood products as hereinafter described.

The wood articles shown in FIGS. 1–6 may have plain surfaces as shown or may have inter-engaging portions forming joints between adjacent wood articles to produce the composite wood product. FIGS. 7–14 illustrate various inter-engaging portions which may be used on one or more of the engaging surfaces described with respect to the profiles shown in FIGS. 1–6. Although the inter-engaging portions may be used with any of the cross-sections of FIGS. 1–6, the profile of wood article 31 shown in FIG. 3 will be described with respect to FIGS. 7–14. Like numerals are applied to corresponding components that were previously described with respect to wood article 31.

Figure 7:
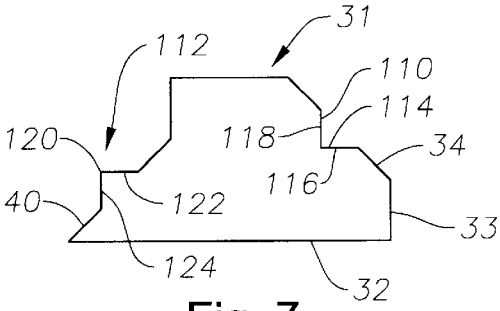
FIG. 7 is an end view of the wood article shown in FIG. 3 having preferred inter-engaging portions.

Referring now to FIG. 7, there is shown wood article 31 having inter-engaging portions 110, 112 in first edge surface 34 and in second edge surface 40, respectively. Inter-engaging portions 110, 112 including recess 110 and boss 112, increase the surface area of flat first and second edge surfaces 34, 40. Each recess 110 and boss 112 in an edge surface is preferably disposed inwardly and outwardly, respectively, with respect to a notional line through the edge surface, the notional line intersecting the outer surface of wood article 31 with an acute angle. Recess 110 is preferably a groove or notch 114 formed by a first side 116 which is preferably parallel with outer surface 32 and a second side 118 which is preferably perpendicular to outer surface 32. Boss 112 is preferably a finger or protrusion 120 formed by a first side 122 which is preferably parallel with outer surface 32 and a second side 124 which is preferably perpendicular to outer surface 32. Protrusion 120 is preferably sized to have the same dimensions as notch 114 such that mating wood articles 31 having inter-engaging portions 110, 112 will allow notches 114 and protrusions 120 to inter-engage. Protrusion 120 preferably has a triangle shaped cross-section and more preferably the shape of a substantially right triangle.

Figure 8:
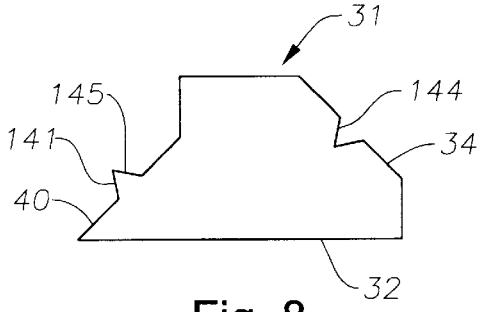
FIG. 8 is an end view of the wood article shown in FIG. 3 having alternative inter-engaging portions to those shown in FIG. 7.
Figure 9:
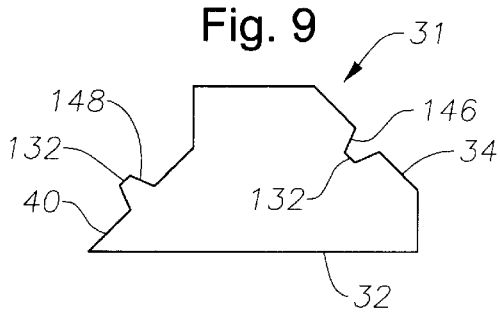
FIG. 9 is an end view of the wood article shown in FIG. 3 having still other alternative inter-engaging portions to those shown in FIG. 7.
Figure 10:
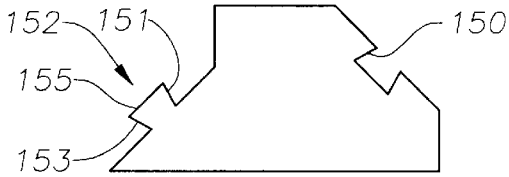
FIG. 10 is an end view of the wood article shown in FIG. 3 having further alternative inter-engaging portions to those shown in FIG. 7.
Figure 11:
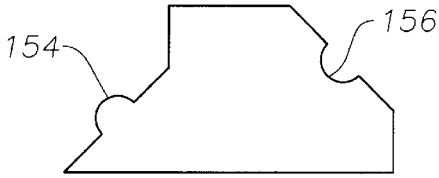
FIG. 11 is an end view of the wood article shown in FIG. 3 having still further alternative inter-engaging portions to those shown in FIG. 7.

Referring now to FIGS. 8–14, there are illustrated embodiments of inter-engaging portions like that of notch 114 and protrusion 120. FIG. 8 shows a notch 144 in edge surface 34 and a protrusion 145 in edge surface 40 which have a triangular cross-section where the apex angle 141 is an acute angle. Alternatively, FIG. 9 shows a notch 146 in edge surface 34 and a protrusion 148 in edge surface 40 having a cross-section of a truncated triangle. The truncated triangle forms a flat surface 132 in notch 146 and on protrusion 148. FIG. 10 illustrates still another embodiment with a notch 150 in edge surface 34 and a protrusion 152 in edge surface 40 having a trapezoidal cross-section. The sides 151, 153 may be perpendicular to top surface 155 or at an angle as shown in FIG. 10. FIG. 11 shows a notch 156 in edge surface 34 and a protrusion 158 in edge surface 40 having an arcuate cross-section.

Figure 12:
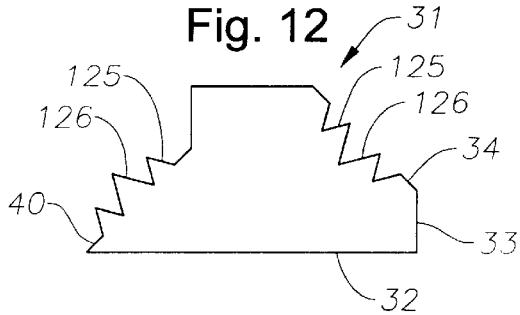
FIG. 12 is an end view of the wood article shown in FIG. 3 having a combination of the inter-engaging portions shown in FIG. 8.
Figure 13:
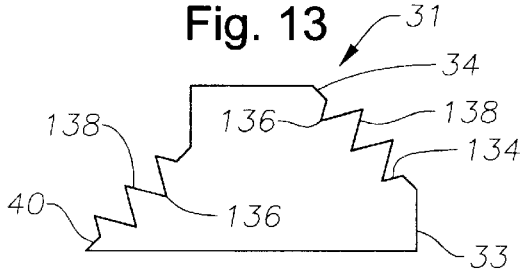
FIG. 13 is an end view of the wood article shown in FIG. 3 having an alternative combination of the inter-engaging portions shown in FIG. 8.
Figure 14:
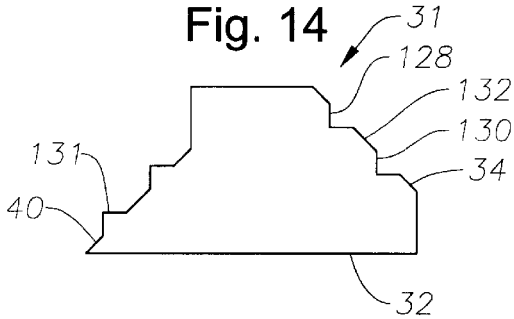
FIG. 14 is an end view of the wood article shown in FIG. 3 having a combination of the inter-engaging portions shown in FIG. 7.

Referring now to FIGS. 12–14, it should be appreciated that the inter-engaging portions, like notch 114 and protrusion 120, may be in multiples on edge surfaces 34, 40 or in a mixed combination thereof. Adjacent protrusions may vary in size or shape or both. FIG. 12 illustrates a plurality of protrusions 125, 126 on edge surfaces 34, 40. Protrusions 125 may be smaller than protrusions 126. FIG. 13 shows a plurality of protrusions 138 having notches 136 therebetween along edge surfaces 34, 40. The protrusions 138 may have the same height. It is preferred that a protrusion be located adjacent an acute angle. FIG. 14 shows a combination of previously described notches and protrusions. On edge surface 34, there is disposed a protrusion having a cross-section like a truncated triangle forming flat surface 132 with a triangular notch 130 on each side in the form of a right angle. On edge surface 40, there is disposed a plurality of triangular protrusions 131. It should be appreciated that the inter-engaging portions may take other shapes, such as a tongue and groove, a lock and key, arcs, squares and the like, and may include combinations thereof. It should be appreciated that the notches and protrusions shown in FIGS. 7–14 may exchanged, so that they are on the opposite sides as shown.

The wood articles shown in FIGS. 1–14 may be combined to form wood products. Although any of the wood articles described above having any of the inter-engaging portions described above may be used, the profiles of wood articles 10, 20, 31, 54, and 80 will be described with respect to FIGS. 15; 16; 17–19 and 23–24; 20–21; and 20–22, respectively. Like numerals are applied to corresponding components that were previously described with respect to wood articles 10, 20, 31, 54, and 80.

Figure 15:
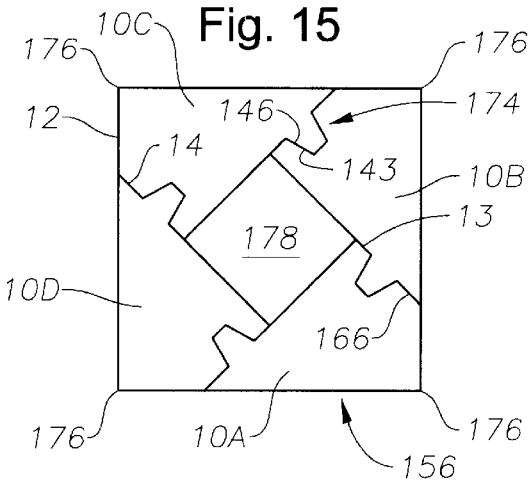
FIG. 15 is an end view of a wood product formed by a plurality of wood articles shown in FIG. 1.

Referring now to FIG. 15, there is shown a composite wood product 156 made up of four wood articles 10A, B, C, and D of FIG. 1, each having the inter-engaging portions of FIG. 9. Each first edge surface 13 on converted wood articles 10A, B, C, and D is adjacent to a corresponding second edge surface 14 on another one of the converted wood articles 10A, B, C, and D. Each protrusion 148 is received by and mated with a corresponding notch 146 thereby forming a joint 174 between first and second edge surfaces 13, 14. The engaging portions of surfaces 13, 14, including joint 174, are glued together by any suitable glue as is well known in the art to one skilled in the art. The wood articles 10 are dimensioned such that the assembled composite wood product 156 has a rectangular or square cross-section as desired. In a square wood product, the length of second edge surface 14 is preferably at least the length of mating edge surface 13. Each outer corner 176 of wood product 156 is separated from each joint 174 by an extension surface 12. Thus, composite wood product 156 has increased strength as compared to a wood product having a joint extending out to its outer corners, such as may occur in a wood product using converted wood articles with a triangular notional cross-section. A hollow center section 178 is formed which may receive a center strengthening member (not shown).

Figure 16:
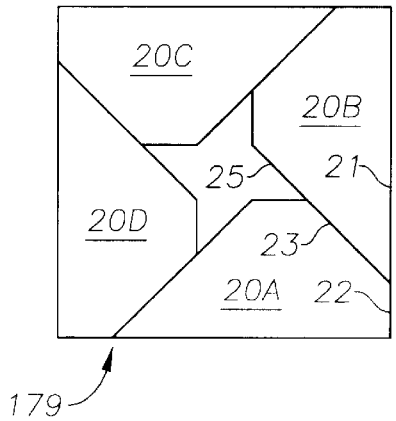
FIG. 16 is an end view of another wood product formed by a plurality of wood articles shown in FIG. 2.

Referring now to FIG. 16, there is shown a composite wood product 179 made up of four wood articles 20A, B, C, and. D. Composite wood product 179 also includes an edge surface 23 displaced from an outer surface 21, with extension surface 22 between surfaces 21,23. In a square wood product, the length of second edge surface 25 is preferably at least the length of mating edge surface 23. Although not shown, it is preferred that the edge surfaces of composite wood article 179 are profiled to include inter-engaging portions.

Figure 18:
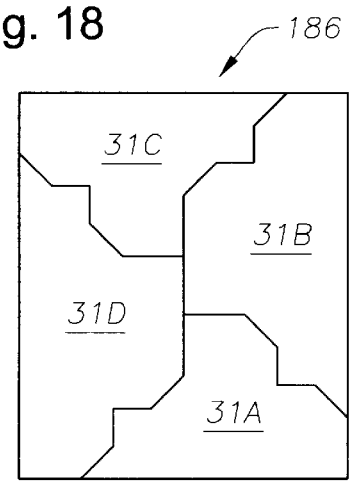
FIG. 18 is an end view of yet another wood product formed by a plurality of wood articles shown in FIG. 3.
Figure 19:
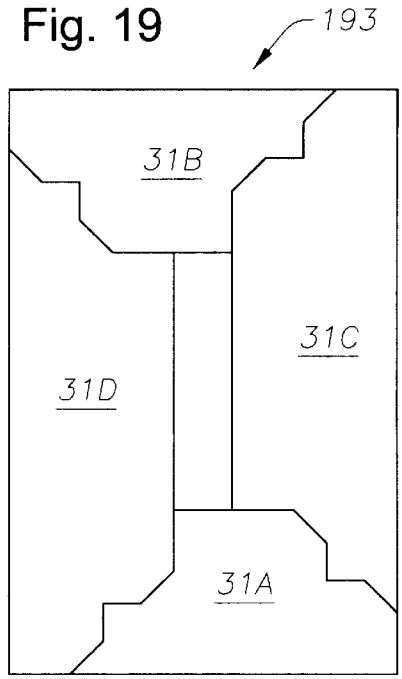
FIG. 19 is an end view of still yet another wood product formed by a plurality of wood articles shown in FIG. 3.
Figure 17:
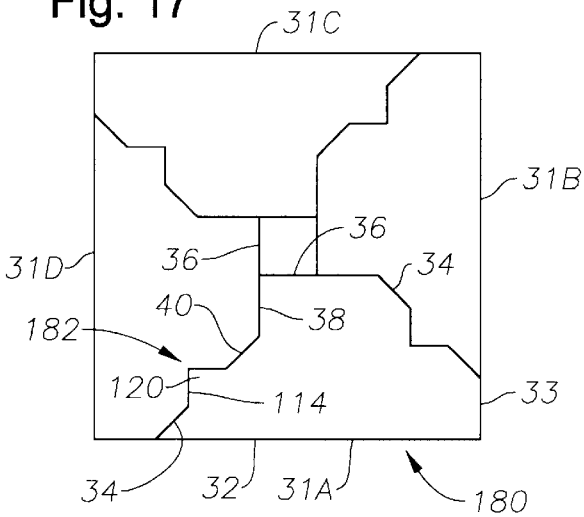
FIG. 17 is an end view of still another wood product formed by a plurality of wood articles shown in FIG. 3.

Referring now to FIG. 17, there is shown a composite wood product 180 made up of four wood articles 31A, B, C, and D of FIG. 3, each having the inter-engaging portions of FIG. 7. Each first edge surface 34 on converted wood articles 31A, B, C, and D is adjacent to a corresponding second edge surface 40 on another one of the converted wood articles 31A, B, C, and D. In a square wood product, the lengths of mating edge surfaces 34, 40 are preferably substantially the same. A protrusion 120 in edge surface 34 is received within a corresponding notch 114 in edge surface 40 to form a joint 182. Each second extension surface 38 is preferably bonded to a portion of adjacent symmetry surface 36. This configuration has the advantage of tending to further strengthen wood product 180. A hollow center section is formed which may receive a center strengthening member (not shown). Referring now to FIG. 18, composite wood product 186 does not include a hollow section. Referring now to FIG. 19, composite wood product 193 is made up of converted wood articles 31A–B and 31C–D having different sizes. Referring again to FIGS. 18, 19, composite wood products 186, 193 may have a rectangular cross-section with non-equal length adjacent sides.

Figure 20:
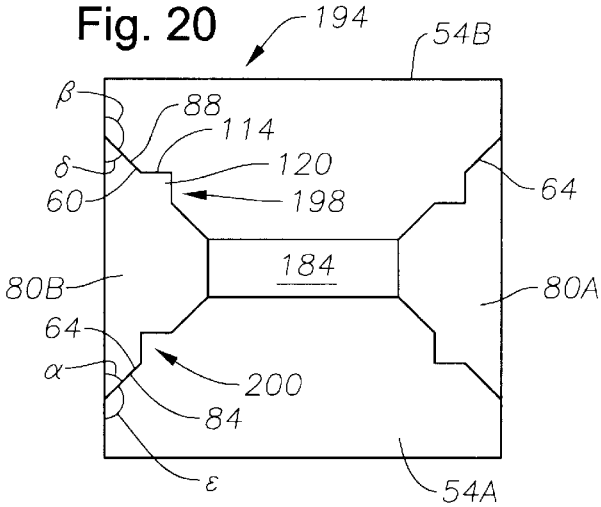
FIG. 20 is an end view of a further alternative wood product formed by a plurality of wood articles shown in FIGS. 4 and 5.

Referring now to FIG. 20, there is shown a composite wood product 194 made up of two opposed wood articles 54A and B and two opposed wood articles 80A and B, shown in FIGS. 3 and 4, respectively. Each of the wood articles 54A, B and 80A, B have the inter-engaging portions of FIG. 8. Each edge surface 60 on converted wood articles 54A, B is adjacent to a corresponding edge surface 88 on one of the converted wood articles 80A, B and each edge surface 64, 84 on converted wood articles 54A, B is adjacent to a corresponding edge surface 84 on one of the converted wood articles 80A, B. Angles $\alpha$, $\epsilon$ are preferably sum to approximately 180° and the lengths of mating edge surfaces 64, are preferably substantially the same. Likewise, angles $\beta$, $\delta$, preferably sum to approximately 180° and the lengths of mating edge surfaces 60, 88 are preferably substantially the same. Each protrusion 120 is received by and mated with a corresponding notch 114 thereby forming a joint 198, 200 between edge surfaces 60, 88 and 64, 84. The engaging portions of surfaces 34, 40, including joints 198, 200 are glued together by any suitable glue as is well known in the art to one skilled in the art. A hollow center section 184 is formed which may receive a center strengthening member (not shown).

Figure 21:
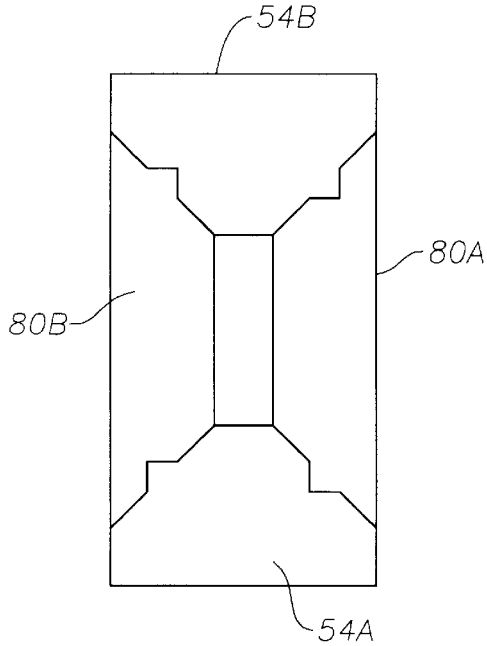
FIG. 21 is an end view of still another wood product formed by a plurality of wood articles shown in FIG. 4 and 5.

As shown in FIG. 21, a wood product 196, which is similar to wood product 194, may have converted wood articles 54, 80 of a different size. Thus, the embodiments may be designed for use with converted wood articles from different diameter logs. The wood product 196 of FIG. 21 has a cross-section in the shape of a rectangle with non-equal length adjacent sides.

Referring now to FIGS. 22, there is shown a composite wood product 210 which includes an inner composite wood product 212 enclosed in a plurality of standard wood articles 98 shown in FIG. 6. The inner composite wood product 212 is made up of four opposed wood articles 80A, B, C, and D shown in FIG. 5. Each of the wood articles 80A, B, C and D have the inter-engaging portions of FIG. 7. Each edge surface 88 on converted wood articles 80A, B, C and D is adjacent to a corresponding edge surface 84 on one of the other converted wood articles 80A, B, C and D. In a square wood product, the lengths of mating edge surfaces 60, 64 are preferably substantially the same and the lengths of mating extension surfaces 58, 66 are preferably substantially the same. Each protrusion 120 is received by and mated with a corresponding notch 114 thereby forming a joint 214 between edge surfaces 84, 88. The engaging portions of surfaces 84, 88, including joint 214 is glued together by any suitable glue as is well known to one skilled in the art. A hollow center section 216 is formed which may receive a center strengthening member (not shown). Four standard wood articles 98 are then glued to the outside of inner wood article 212. Wood product 210 has the advantage that it may include converted wood articles derived from logs with a smaller diameter than the dimension of wood product 210.

Referring now to FIG. 23, a different combination is shown in producing wood product 230. Wood product 230 includes the inner wood product 180 shown in FIG. 15 in combination with rectangular standard wood pieces 98A, B, C, and D. Each wood piece 98B and C is preferably bonded to one side, i.e., surfaces 32, 33, of inner wood article 180 forming joints 256 therebetween. Standard wood articles 98A and 98D are bonded to the outside of wood articles 98B and 98C respectively forming joints 254 therebetween as described above. Joints 254, 256 may optionally include mated inter-engaging portions. Standard wood pieces 98 may be added singly or in combination. For example, one (not shown), two, or three (not shown), or more (not shown) standard wood pieces 98 may be added to a side of inner wood article 180. Further, standard wood pieces 98 may be symmetrically or asymmetrically arrayed on the outside of inner wood article 180. For example, one standard wood piece 98 may be added to one side of inner wood produce 180 and no wood pieces added to the other sides (not shown). Standard wood pieces 98 may be included for additional strength. Alternatively, standard wood pieces 98 may be included to extend wood product 230 to a standard size.

It is understood that composite wood products may be arrayed together, preferably laminated together to form a larger composite wood product. The composite wood product may be planed to obtain desirable dimensions.

Referring now to FIG. 24, there is shown a composite wood product 258 made up of a plurality of wood articles 31A–C, shown in FIG. 3 and end wood articles 257A–B. Each of the wood articles 31A–C, 257A–B have the inter-engaging portions of FIG. 7. As distinguished from the previously described composite wood products which illustrated opposing wood articles, the wood product 258 includes wood articles 31A–C, 257A–B which are arranged side-by-side. Each edge surface 34 and extension surface 33 on converted wood articles 31A–C are adjacent to a corresponding second extension surface 38, 259 and second edge surface 40, 261 on one of the other converted wood articles 31A–C or end articles 257A–B. Each protrusion 120 is received by and mated with a corresponding notch 114 thereby forming a joint 260 between edge surfaces 34, 40. The engaging surfaces 32, 34, 38, and 40,including joint 260 are glued together by any suitable glue as is well known to one skilled in the art. Wood product 258 includes converted wood articles 31A–C arrayed in cross-section along a notional line 262. Outer edges 264 of wood product 258 may be cut from articles 31E–F (not shown) to form end articles 257–AB after joining converted wood articles 31A–E.

Referring now to FIG. 25, alternatively a converted wood article may be cut along notional plane 266 to form articles 268, 270. Articles 268, 270 may be placed at either end 264 to form end articles 272, 274.

The converted wood article of the preferred embodiment having engaging surfaces with inter-engaging portions preferably has various elements of asymmetry, including an asymmetric. In particular, a converted wood article having inter-engaging portions is preferably is asymmetric about a notional plane bisecting the outer surface of the converted wood article and substantially perpendicular to the outer surface. The asymmetry may arise from any of the overall shape of the cross-section, the shape of inter-engaging portions and the arrangement of inter-engaging portions. A notional plane through each engaging surface included on the converted wood articles of the preferred embodiment is oriented at an acute angle with respect to an outer surface. Each portion of an engaging surface which is not a part of an inter-engaging portion is preferably substantially superposed on the notional plane associated with that surface. Each inter-engaging portion of an engaging surface is a boss extending outwardly from the notional plane associated with that surface or a recess extending inwardly from the notional plane. Further, each inter-engaging portion preferably includes a surface which is neither parallel nor perpendicular to the outer surface. The above aspects of asymmetry have the advantage that composite wood articles formed from the preferred converted wood articles have increased resistance to loading forces which tend to stress the joints between profiled surfaces.

Preferential location within a wood product of standard wood pieces according to grade or modulus of elasticity (MOE) is known in the art, for example as taught in pages 19 and 21–24 of AITC-93—Manufacturing Standard Specifications for Structural Glued Laminated Timber of Softwood Species, published by American Institute of Timber Construction, 1993 and in U.S. Pat. No. 3,580,760, each hereby incorporated herein by reference. For example, referring to FIGS. 22, 23, standard wood pieces 98 which are arrayed around converted wood articles may have a higher MOE than the converted wood articles. Likewise, the converted wood articles of the preferred embodiment may be disposed within the wood product according to MOE. For example, referring to FIGS. 15–23, one pair of opposed converted wood articles may have a higher MOE than the other pair of opposed converted wood articles in the same wood product.

Methods of forming converted wood articles are known in the art, such as disclosed in U.S. Pat. No. 5,870,876, hereby incorporated herein by reference. Converted wood articles of the preferred embodiment are preferably cut from logs. If log size permits, a log may be first cut into precursors fitting two across the diameter of the log. Alternately, a log may be cut into precursors having about the same cross-sectional size as the log. The cut precursors may be kiln dried, as is known to one of ordinary skill in the art. The logs may be cut from any suitable species of tree. Preferably the logs are cut from southern pine. Precursors are processed to form an elongated converted wood article. Techniques known to one of ordinary skill in the art, such as finger jointing may be used to join precursors together end to end to extend their length. Logs, precursors, converted wood articles, or wood pieces may optionally be rated according to MOE using standard methods well known in the art. For example, modulus of elasticity may be detected by a machine stress rating (MSR) machine which uses a measurement of wood deflection resulting from application of a bending force to a piece of lumber. The amount of deflection depends on the stiffness of the lumber under test. As taught, for example, in U.S. Pat. No. 5,503,024, hereby incorporated herein by reference, MOE is related to stiffness through the lumber cross-section size and bending length. Alternatively, visual grading may be used alone or in combination with machine stress rating according to MOE.

A method of making a converted wood article preferably includes the steps of sawing wood logs, producing wood precursors, drying the wood precursors, finger-jointing wood precursors end to end, producing a converted wood article, and profiling the converted wood article. An alternative preferred method of making a converted wood article preferably includes the steps of sawing wood logs, producing wood precursors, drying the wood precursors, rating each wood precursor according to MOE; finger-jointing MOE-rated wood precursors end to end, producing an MOE-rated converted wood article, and profiling the MOE-rated converted wood article.

The above described methods of making a converted wood article preferably include the step of shaping the converted wood article to have a cross-section and profiles as described above.

A method of making a composite wood product preferably includes the steps of producing a plurality of converted wood articles, applying resin to bonding surfaces on each converted wood article, orienting the bonding surfaces of each converted wood article to form a composite, pressing the composite until the resin cures, and planing the composite to desired dimensions. The method may further include orienting standard wood pieces around the oriented converted wood articles. This step may occur before or after bonding the converted wood articles together by pressing the composite until the resin cures. Thus, a composite wood article may include within it a composite. The standard wood pieces may be MOE-rated standard wood pieces. Thus, the method of making a composite wood product may further include disposing standard wood pieces in the composite wood product according to MOE.

An alternative preferred method of making a composite wood product uses the various MOE-rated profiled pieces in specific locations within the composite and includes the steps of producing a plurality of MOE-rated converted wood articles, disposing the MOE-rated converted wood articles in the wood product according to MOE, applying resin to bonding surfaces on each MOE-rated converted wood article, orienting the bonding surfaces of each MOE-rated converted wood article to produce the composite, pressing the composite until the resin cures, and dressing (planing) the composite to desired dimensions. The step of locating the articles may further include the steps of dividing the MOE-rated converted wood articles into a higher-MOE group and a lower MOE group, and forming a wood product by opposing a pair of higher MOE-rated converted wood articles and an opposing pair of lower MOE-rated converted wood articles The method may further include orienting standard wood pieces around the oriented converted wood articles. This step may occur before or after bonding the converted wood articles together by pressing the composite until the resin cures. Thus, a composite wood article may include within it a composite. The standard wood pieces may be MOE-rated standard wood pieces. Thus, the method may further include locating standard wood pieces according to MOE.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A composite wood product, comprising:

a plurality of elongated pieces of wood, each piece having a cross section forming a plurality of surfaces;

said plurality of surfaces including first and second non-engaging surfaces and first, second, third and fourth engaging surfaces;

said first non-engaging surface and said fourth engaging surface being substantially parallel;

said first engaging surface forming an obtuse angle with said second non-engaging surface and said second engaging surface forming an obtuse angle with said third engaging surface;

said second engaging surface and said first non-engaging surface forming an acute angle; and said first and second non-engaging surfaces forming a substantially right angle;

wherein there are four wood pieces arranged in opposing pairs wherein each of said paired wood pieces have substantially the same modulus of elasticity; and wherein the wood pieces of one of said opposing pairs has a higher modulus of elasticity than the wood pieces of the other of said opposing pairs.

2. A converted wood article comprising:

an elongated piece of wood having a cross-section forming first and second non-engaging surfaces, and first, second and third engaging surfaces;

one of said first and second engaging surfaces having a recess;

the other of said first and second engaging surfaces having a boss, said recess and boss having corresponding cross-sections;

said cross-section being substantially asymmetric about a notional plane bisecting said first non-engaging surface and substantially perpendicular to said first non-engaging surface;

one of said first and second engaging surfaces being contiguous with said second non-engaging surface extending between said one of said first and second engaging surfaces and said first non-engaging surface; and said other of said first and second engaging surfaces extending between said first non-engaging surface and said third engaging surface.

3. The converted wood article of claim 2, wherein a notional plane through said one of said first and second engaging surfaces forms an acute angle with a notional plane through said first non-engaging surface and said other of said first and second engaging surfaces forms an acute angle with said first non engaging surface.

4. The converted wood article of claim 1, wherein each said engaging surface includes a plurality of recesses and bosses.

5. The converted wood article of claim 1, wherein said boss and recess include a tongue and a groove.

6. The converted wood article of claim 1, wherein said recess and boss include a lock and a key.

7. The converted wood article of claim 1, wherein said cross-section is selected from the group consisting of a triangle, a truncated triangle, a trapezoid, an arc, and a square.

8. The converted wood article of claim 1, further comprising an extension surface extending between one of said engaging surfaces and said outer surface.

9. The converted wood article of claim 2, wherein a notional plane through said second non-engaging surface forms a substantially right angle with a notional plane through said first non-engaging surface.

10. The converted wood article of claim 2, further comprising a symmetry surface extending from one of said first and second engaging surfaces and which is parallel to said first non-engaging surface.

11. The converted wood article of claim 10, wherein said third engaging surface extends from said symmetry surface to the other one of said first and second engaging surfaces.

12. The converted wood article of claim 11, wherein a notional plane through said third engaging surface forms a substantially right angle with a notional plane through said symmetry surface.

13. A composite wood product, comprising:

a plurality of elongated pieces of wood, each piece having a cross section forming a plurality of surfaces;

said plurality of surfaces including first and second non-engaging surfaces and first, second, third and fourth engaging surfaces;

said first non-engaging surface and said fourth engaging surface being substantially parallel;

said first engaging surface forming an obtuse angle with said second non-engaging surface and said second engaging surface forming an obtuse angle with said third engaging surface;

said second engaging surface and said first non-engaging surface forming an acute angle; and said first and second non-engaging surfaces forming a substantially right angle.

14. The composite wood product of claim 13, wherein there are four wood pieces arranged in opposing pairs wherein each of said paired wood pieces have substantially the same modulus of elasticity.

15. The composite wood product of claim 13, further comprising a rectangular elongated wood board joined to said first non-engaging surface of at least one of said wood pieces.

16. The composite wood product of claim 15, wherein said rectangular elongated wood board has a higher modulus of elasticity than said elongated wood pieces.

17. A composite wood product comprising:

at least two converted wood articles having a cross-section comprising a six-sided polygon, wherein each cross-section includes first and second sides having notional lines therethrough forming an acute angle with a notional line through a third side, a fourth side adjacent said third side and one of said first and second sides wherein the notional line through said third side forms a substantially right angle with a notional line through said fourth side wherein said fourth side forms a substantially obtuse angle with said one of said first and second sides, and a fifth side which forms a substantially obtuse angle with the other of said first and second sides, said converted wood articles being adjacent such that each of said first sides is adjacent a second side.

18. A composite wood product, comprising:

four elongated pieces of wood, each wood piece having an outer surface and first and second engaging surfaces;

one of said first and second engaging surfaces having a recess;

the other of said first and second engaging surfaces having a boss, said recess and boss having corresponding shapes;

an extension surface extending between said first engaging surface and said outer surface;

each wood piece being asymmetric about a notional plane bisecting said outer surface and substantially perpendicular to said outer surface;

notional planes passing through each of said engaging surfaces forming an acute angle with a notional plane passing through said outer surface; and each first engaging surface of a piece of wood being joined to another second engaging surface on another piece of wood, such that the composite wood product has a substantially rectangular or square cross-section.

19. The composite wood product of claim 18, wherein the wood pieces are arranged in opposing pairs and wherein said paired wood pieces have substantially the same modulus of elasticity.

20. The composite wood product of claim 19, wherein the wood pieces of one of said opposing pairs has a higher modulus of elasticity than the wood pieces of the other of said opposing pairs.

21. The composite wood product of claim 18, further comprising:

a rectangular elongated wood piece joined to a side of said composite wood article and having a rectangular cross-section.

22. The composite wood product of claim 21, further comprising another rectangular wood piece joined to an opposite side of said composite wood article.

23. The composite wood product of claim 22, wherein said rectangular wood pieces each have a higher modulus of elasticity than said elongated wood pieces.

24. The composite wood product of claim 23, wherein said rectangular wood pieces have substantially the same modulus of elasticity and said elongated wood pieces each have substantially the same modulus of elasticity.

25. The composite wood product of claim 22, wherein said rectangular wood pieces each have a first modulus of elasticity and each are joined to an elongated wood article having a second modulus of elasticity, said elongated wood articles which are not joined to said rectangular wood pieces having a third modulus of elasticity.

26. The composite wood product of claim 25, wherein said first modulus of elasticity is greater than said third modulus of elasticity; and wherein said third modulus of elasticity is greater than said second modulus of elasticity.

27. The composite wood product of claim 26, wherein said first modulus of elasticity is greater than said second modulus of elasticity and wherein said second modulus of elasticity is greater than said third modulus of elasticity.

28. The composite wood product of claim 18, wherein each said engaging surface includes a plurality of recesses and bosses.

29. The composite wood product of claim 18, wherein said boss and recess include a tongue and a groove.

30. The composite wood product of claim 18, wherein said recess and boss include a lock and a key.

31. The composite wood product of claim 18, wherein said boss and recess have a cross-section selected from the group consisting of a triangle, a truncated triangle, a trapezoid, an arc, and a square.

32. A composite wood product, comprising:

at least two elongated pieces of wood, each piece having a plurality of surfaces forming a profile selected from the group consisting of four-sided, five-sided, and six-sided polygons surfaces;

wherein said surfaces comprise:

an outer surface;

an engaging surface; and an extension surface extending between said outer surface and said engaging surface;

wherein said extension surface and said outer surface form a corner having a substantially right angle; and wherein said extension surface and said engaging surface form a second corner having an obtuse angle; and wherein said composite wood product has a cross-section selected from the group consisting of substantially square cross-sections and substantially rectangular cross-sections.

33. The composite wood product according to claim 32 wherein each of said at least two wood pieces further comprises a second engaging surface, wherein a notional plane through said second engaging surface intersects a notional plane through said outer surface at an acute angle.

34. The composite wood product according to claim 33 wherein each of said at least two wood pieces further comprises a symmetry surface adjacent said second engaging surface and substantially parallel to said outer surface.

35. The composite wood product according to claim 34 wherein each of said at least two wood pieces further comprises a second extension surface adjacent said second engaging surface.

36. The composite wood product according to claim 35 wherein said second extension surface extends between said outer surface and said second engaging surface.

37. The composite wood product according to claim 35 wherein said second extension surface extends between said second engaging surface and said symmetry surface.

38. The composite wood product according to claim 37 wherein said second engaging surface and said outer surface form a third corner having said acute angle; and wherein said second engaging surface and said second extension surface form a fourth corner having a second obtuse angle.

39. The composite wood product according to claim 38 wherein said first and second obtuse angles are the same.

40. The composite wood product according to claim 37 wherein said composite wood product has a rectangular cross-section.

41. The composite wood product according to claim 37 wherein said composite wood product has a square cross-section.

42. The composite wood product according to claim 37 wherein one of said first and second engaging surfaces comprises a boss and the other of said first and second of said engaging surfaces comprises a recess, said recess and said boss having corresponding shapes.

43. The composite wood product according to claim 42 wherein said corresponding shapes are selected from the group consisting of a triangle, a truncated triangle, a trapezoid, an arc, and a square.

44. The composite wood product according to claim 42 wherein one of said one and said other engaging surfaces comprises a second boss and the other of said one and said other engaging surfaces comprises a second recess, said second recess and said second boss having second corresponding shapes.

45. The composite wood product according to claim 37 wherein a first of said wood pieces and a second of said wood pieces are adjacent, said first engaging surface of said first piece engaging said second engaging surface of said second piece.

46. The composite wood product according to claim 37 wherein a first of said wood pieces and a second of said wood pieces are arranged in an opposing pair.

47. The composite wood product according to claim 46 wherein a third and a fourth of said at least two wood pieces are arranged in an opposing pair.

48. The composite wood product according to claim 47 wherein said first, second, third, and fourth wood pieces define a void therebetween.

49. The composite wood product according to claim 47 wherein the surfaces of each of said wood pieces form the same profile.

50. The composite wood product according to claim 47, wherein said first and second wood pieces have substantially the same modulus of elasticity and said third and fourth wood pieces have substantially the same modulus of elasticity.

51. The composite wood product of claim 50, wherein at least one of said first and second moduluses of elasticity is higher than the other of said moduluses of elasticity.

52. The composite wood product of claim 47, further comprising a rectangular elongated wood piece joined to a side of said composite wood article and having a rectangular cross-section.

53. The composite wood product of claim 52, further comprising another rectangular wood piece joined to an opposite side of said composite wood article.

54. The composite wood product of claim 53, wherein said rectangular wood pieces each have a higher modulus of elasticity than said elongated wood pieces.

55. The composite wood product of claim 53, wherein said rectangular wood pieces have substantially the same modulus of elasticity and said elongated wood pieces each have substantially the same modulus of elasticity.

56. The composite wood product of claim 53, wherein said rectangular wood pieces each have a first modulus of elasticity and each are joined to an elongated wood article having a second modulus of elasticity, said elongated wood articles not joined with said rectangular wood pieces having a third modulus of elasticity.

57. The composite wood product of claim 56, wherein said first modulus of elasticity is greater than said third modulus of elasticity; and wherein said third modulus of elasticity is greater than said second modulus of elasticity.

58. The composite wood product of claim 56, wherein said first modulus of elasticity is greater than said second modulus of elasticity and wherein said second modulus of elasticity is greater than said third modulus of elasticity.

59. The composite wood product according to claim 38 wherein said first obtuse angle and said acute angle sum to 180°.

60. A converted wood article comprising:

an elongated piece of wood having a cross-section forming first and second non-engaging surfaces and first, second and third engaging surfaces;

first and second engaging surfaces each having a recess or a boss;

said second non-engaging surface extending between said first engaging surface and said first non-engaging surface;

said second engaging surface extending between said first non-engaging surface and said third engaging surface; and a notional plane through said first engaging surface forming an acute angle with a notional plane through said first non-engaging surface and said second engaging surface forming an acute angle with said first non-engaging surface.

61. The converted wood article of claim 60, wherein said cross section is substantially asymmetric about a notional plane bisecting said first non-engaging surface and substantially perpendicular to said first non-engaging surface.

62. The converted wood article of claim 60, wherein said third engaging surface forms a substantially obtuse angle with said second engaging surface, and further including a sixth surface which forms a substantially obtuse angle with said first engaging surface.

63. A converted wood article having a cross-section forming a six-sided polygon, wherein each cross-section includes first and second sides having notional lines therethrough forming an acute angle with a notional line through a third side, a fourth side adjacent said third side and one of said first and second sides wherein the notional line through said third side forms a substantially right angle with a notional line through said fourth side wherein said fourth side forms a substantially obtuse angle with said one of said first and second sides, and a fifth side which forms a substantially obtuse angle with the other of said first and second sides.

64. The converted wood article of claim 63 wherein each said first and second sides comprise inter-engaging cross-sections selected from the group of triangles, truncated triangles, trapezoids, arcs, and squares.

* * * * *